US007002446B2

(12) United States Patent
Ito et al.

(10) Patent No.: US 7,002,446 B2
(45) Date of Patent: Feb. 21, 2006

(54) COIL COMPONENT

(75) Inventors: Tomokazu Ito, Tokyo (JP); Takashi Kudo, Tokyo (JP); Makoto Otomo, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/113,092

(22) Filed: Apr. 25, 2005

(65) Prior Publication Data

US 2005/0253677 A1 Nov. 17, 2005

(30) Foreign Application Priority Data

Apr. 28, 2004 (JP) ..... 2004-133243

(51) Int. Cl.
*H01F 5/00* (2006.01)

(52) U.S. Cl. ..... 336/200

(58) Field of Classification Search ..... 336/65, 336/83, 200–208, 232; 257/531
See application file for complete search history.

(56) References Cited

U.S. PATENT DOCUMENTS 5,477,204 A * 12/1995 Li ..... 336/200
5,969,590 A * 10/1999 Gutierrez ..... 336/200
6,618,929 B1 * 9/2003 Kitamura ..... 29/602.1
2004/0061587 A1 * 4/2004 Hong et al. ..... 336/200
2005/0023639 A1 * 2/2005 Yeh et al. ..... 257/531

FOREIGN PATENT DOCUMENTS

JP A-08-203737 8/1996
JP A-2003-217932 7/2003

* cited by examiner

*Primary Examiner*—Tuyen T Nguyen
(74) *Attorney, Agent, or Firm*—Oliff & Berridge, PLC

(57) ABSTRACT

The invention relates to surface-mount coil component including a mount surface mounted on a printed circuit board or a hybrid IC (HIC), and provides a small and low-profile coil component excellent in impedance characteristic. The coil component includes coil conductors each of which includes a major wiring region having the number N of wiring lines and a minor wiring region arranged to be opposite to the major wiring region and having the number (N−1) of wiring lines, and is arranged so that a major wiring side interval as an interval between an outermost periphery of the major wiring region and one side part of the substrate opposite thereto is longer than a minor wiring side interval as an interval between an outermost periphery of the minor wiring region and the other side part of the substrate opposite thereto.

5 Claims, 6 Drawing Sheets

COIL COMPONENT

BACKGROUND OF THE INVENTION

1. Field of the Invention

The present invention relates to a surface-mount coil component having a mount surface mounted on a printed circuit board or a hybrid IC (HIC).

2. Description of the Related Art

As a coil component mounted on an inner circuit of an electronic equipment such as a personal computer or a cellular phone, there are known a winding type in which a copper wire is wound around a ferrite core, a lamination type in which a coil conductor pattern is formed on the surface of a magnetic sheet of ferrite or the like and the magnetic sheet is laminated, and a thin film type in which an insulating film and a coil conductor of a metal thin film are alternately formed by using a thin film formation technique.

Patent document 1 (JP-A-8-203737) discloses a common mode choke coil as a thin film type coil component. Patent document 2 (JP-A-2003-217932) discloses, as a thin film type coil component, a common mode choke coil array in which two common mode choke coils are arranged side by side. The common mode choke coil has such a structure that two coil conductors having almost the same shape are laminated through insulating film between two magnetic substrates arranged to be opposite to each other. FIGS. 6A and 6B show an arrangement shape of a coil conductor of a conventional common mode choke coil. FIG. 6A shows a plane shape of the coil conductor when viewed from a mount surface side of a common mode choke coil 101. In FIG. 6A, in order to make the drawing clear, only a coil conductor 133 is shown out of two laminated coil conductors 133 and 135. FIG. 6B shows a section taken along an imaginary line A—A passing through a center axis of the coil conductor 133 which is shown in FIG. 6A.

As shown in FIG. 6A, the coil conductor 133 is formed into a spiral shape on an insulating film 107*b*. An inner peripheral side end part of the coil conductor 133 is connected via a through hole 131 formed in the insulating film 107*b* to one end part of a lead wire 129 formed in a lower layer of the insulating film 107*b* and indicated by a broken line in the drawing. The other end part of the lead wire 129 is connected to an internal electrode terminal 121 formed at a peripheral end part of the insulating film 107*b*. An outer peripheral side end part of the coil conductor 133 is connected to an internal electrode terminal 125 formed at a peripheral end part of the insulating film 107*b* to be opposite to the internal electrode terminal 121.

As shown in FIG. 6B, an insulating film 107*a*, an insulating film 107*b*, the conductive coil conductor 133, an insulating film 107*c*, the conductive coil conductor 135, an insulating film 107*d*, an insulating film 107*e* and an adhesive layer 111 are laminated in this order between magnetic substrates 103 and 105. The coil conductor 135 is formed into a spiral shape almost similar to the coil conductor 133, and faces the coil conductor 133 through the insulating film 107*c*. Besides, the coil conductor 135 is connected to a lead wire (not shown) formed on the insulating film 107*d* via a through hole (not shown) formed in the insulating film 107*d*.

The coil conductors 133 and 135, the lead wire 129, and the lead wire connected to the coil conductor 135 are embedded in an insulating layer 7 including the insulating films 107*a*, 107*b*, 107*c*, 107*d* and 107*e* to constitute one choke coil. The coil conductor 133 is connected via the lead wire 129 and the internal electrode terminals 121 and 125 to external electrodes (not shown) formed around the magnetic substrates 103 and 105 respectively. Similarly, the coil conductor 135 is connected via the lead wire and the internal electrode terminals to other external electrodes (not shown) formed around the magnetic substrates 103 and 105 respectively.

Incidentally, as electronic equipment such as a personal computer or a cellular phone is miniaturized, an electronic component such as a coil component or the like is required to miniaturize a chip size and to reduce the thickness of the component (to reduce the profile). The winding type coil has a problem that the miniaturization is difficult from the limitation in structure. On the other hand, the lamination type coil and the thin film type common mode choke coil 101 can be miniaturized and reduced in profile.

Besides, in order to raise the impedance of the common mode choke coil 101, it becomes necessary to raise the relative permeability of the magnetic substrates 103, 105 and the insulating layer 107 and to increase the number of turns of the coil conductors 133 and 135. However, in any material, as the frequency of a current supplied to the coil conductors 133 and 135 becomes high, its relative permeability is decreased, and accordingly, there is a problem that high relative permeability is hard to obtain in a high frequency band.

Besides, in order to increase the number of turns of the coil conductors 133 and 135, it is necessary to reduce the conductor width and to narrow the pitch. However, as the common mode choke coil 101 is made smaller, it becomes difficult to thin the coil conductors 133 and 135 and to narrow the pitch.

In the section including the center axis of the coil conductors 133 and 135 shown in FIG. 6B, the number of wiring lines of the coil conductors 133 and 135 is different between the right and left portions with respect to the center axes. The number of magnetic flux lines generated by applying power to the coil conductors 133 and 135 becomes large as the number of wiring lines becomes large. In a case where an interval between the outermost periphery of the coil conductors 133 and 135 and the side part of the magnetic substrates 103 and 105 is made an interval c, since the number of magnetic flux lines generated is small in the region where the number of wiring lines is small, the magnetic flux lines can pass through the region between the outermost periphery of the coil conductors 133 and 135 and the side part of the magnetic substrates 103 and 105. Thus, when power is applied to the coil conductors 133 and 135, a magnetic path M passing through the magnetic substrate 103, the insulating layer 107 of the inner peripheral part of the coil conductors 133 and 135, the adhesive layer 111 on the insulating layer 107, the magnetic substrate 105, the adhesive layer 111, and the insulating layer 107 of the outer peripheral part of the coil conductors 133 and 135 in this order is formed in the region where the number of wiring lines is small.

However, in the region where the number of wiring lines is large, since the number of magnetic flux lines generated is larger than that in the region where the number of wiring lines is small, part of the magnetic flux can not pass through the region between the outermost periphery of the coil conductors 133 and 135 and the side part of the magnetic substrates 103 and 105, and leaks to the outside of the common mode choke coil 101. Thus, the inductance of the coil conductors 133 and 135 can not be sufficiently increased, and there is a problem that it is difficult to sufficiently raise the impedance of the common mode choke coil 101.

In the common mode choke coil array disclosed in patent document 2, two common mode choke coil elements arranged to be adjacent to each other in a chip element body are arranged so that the number of turns at the side where they are adjacent to each other becomes smaller than the number of turns at the side where they are not adjacent to each other. Thus, the portion of the common mode choke coil element in which the number of turns is large is disposed at the peripheral end side of the magnetic substrate. Accordingly, when the common mode choke coil array is made smaller, the interval between the outermost peripheral part of the common mode choke coil element and the peripheral end part of the magnetic substrate becomes short, and part of the magnetic flux lines generated by the common mode choke coil element leaks to the outside of the common mode choke coil array, and there is a problem that the impedance can not be sufficiently raised.

When the interval c between the outermost periphery of the coil conductors 133 and 135 and the side part of the magnetic substrates 103 and 105 is made long in order to prevent the magnetic flux line from leaking to the outside of the common mode choke coil 101, the common mode choke coil 101 becomes large, and accordingly, there is a problem that the component can not be made smaller.

SUMMARY OF THE INVENTION

An object of the invention is to provide a small and low-profile coil component excellent in impedance characteristic.

The object is achieved by a coil component including a pair of substrates arranged to be opposite to each other, and a coil conductor which is formed into a spiral shape between the pair of substrates, includes a major wiring region having the number N of wiring lines and a minor wiring region arranged to be opposite to the major wiring region and having the number (N−1) of wiring lines, and is arranged so that a major wiring side interval as an interval between an outermost periphery of the major wiring region and one side part of the substrate opposite thereto is longer than a minor wiring side interval as an interval between an outermost periphery of the minor wiring region and the other side part of the substrate opposite thereto.

In the coil component of the invention, the two coil conductors are arranged side by side while the major wiring regions face each other.

In the coil component of the invention, another coil conductor is formed between the two coil conductors.

In the coil component of the invention, a magnetic flux passing area in the major wiring side interval is wider than a magnetic flux passing area in the minor wiring side interval.

In the coil component of the invention, an opposite coil conductor arranged to be opposite to the coil conductor through an insulating film and constituting a common mode choke coil is further formed.

According to the invention, the small and low-profile coil component excellent in impedance character can be realized.

DETAILED DESCRIPTION OF THE INVENTION

First Embodiment

Figure 1:
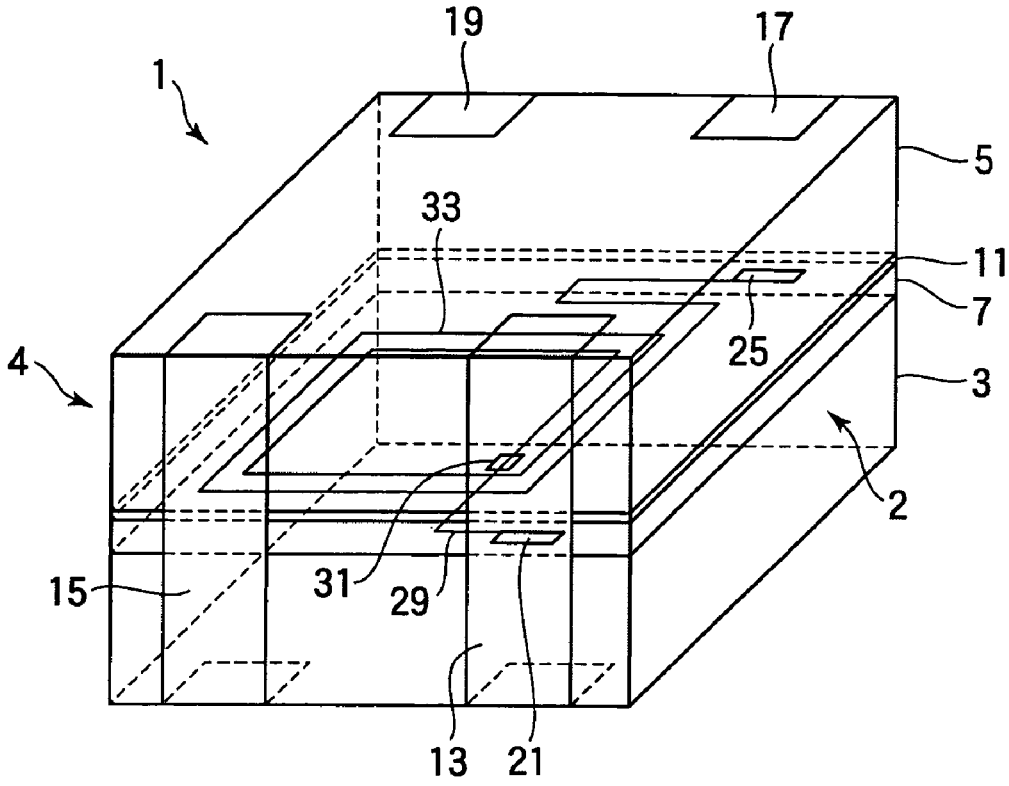
FIG. 1 is a perspective view of a common mode choke coil 1 according to a first embodiment of the invention.

A coil component according to a first embodiment of the invention will be described with reference to FIGS. 1 to 3. In this embodiment, a description will be made while using, as an example of a coil component, a common mode choke coil to suppress a common mode current which causes electromagnetic interference in a balanced transmission system. FIG. 1 is a perspective view showing a common mode choke coil 1. In FIG. 1, in order to facilitate understanding, an internal electrode terminal 21, a coil conductor 33 formed in an insulating layer 7, a lead wire 29 connected to the coil conductor 33 and the through hole 31 via a through hole 31, and an internal electrode terminal 25 connected to the coil conductor 33, which are covered with an external electrode 13 and can not be originally seen, are shown in a transparent manner. Besides, the illustration of a coil conductor 35 and the like laminated on the coil conductor 33 via an insulating film is omitted.

As shown in FIG. 1, the common mode choke coil 1 has a rectangular parallelepiped outer shape formed by laminating thin films between two magnetic substrates 3 and 5 which have thin plate rectangular parallelepiped shapes and are disposed to be opposite to each other. The insulating layer 7, a coil layer in which the coil conductor 33 and the like are formed, and an adhesive layer 11 are sequentially formed between the magnetic substrates 3 and 5 by using a thin film formation technique. A coil conductor 35 (see FIG. 2B) facing the coil conductor 33 through an insulating film is formed in the coil layer.

The external electrode 13 is formed on an exposed side part of the internal electrode terminal 21 and on the respective mount surfaces of the magnetic substrates 3 and 5. External electrodes 15, 17 and 19 are also formed into a shape similar to the external electrode 13. The external electrodes 13 and 17 are respectively electrically connected to the internal electrode terminals 21 and 25 exposed at the side part. The external electrode 13 is electrically connected to the external electrode 17 through the lead wire 29 and the coil conductor 33. The external electrode 15 is electrically connected to the external electrode 19 through the not-shown coil conductor 35 formed to face the coil conductor 33 through the insulating film.

Figure 2A:
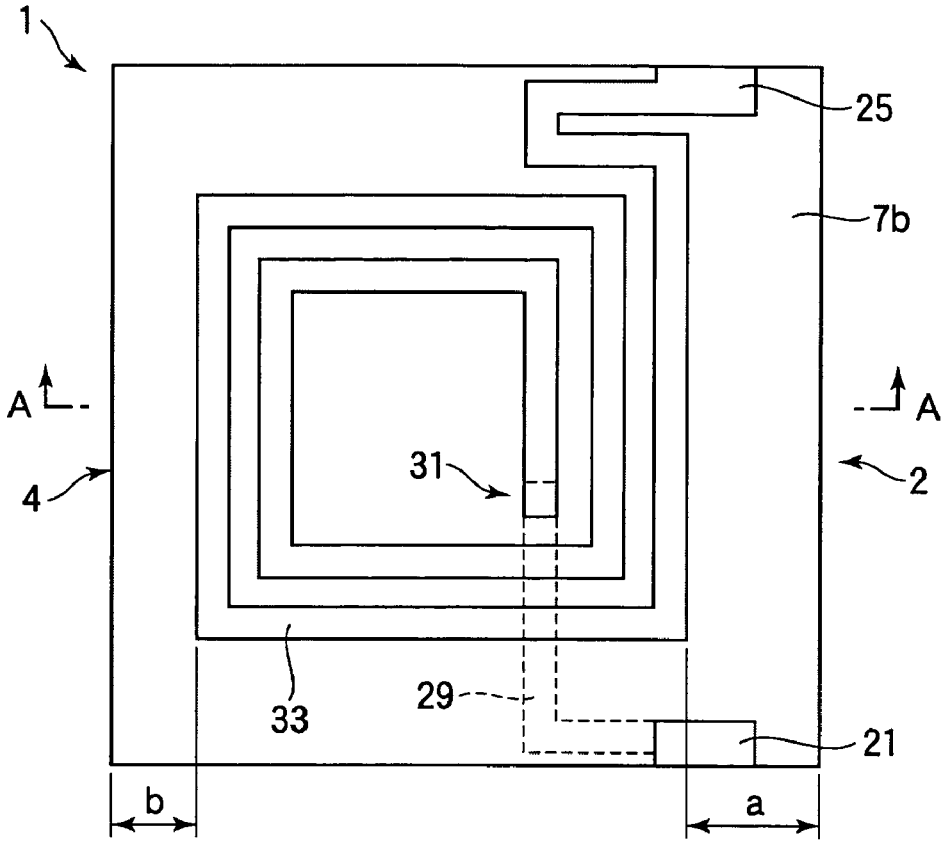
FIGS. 2A and 2B are views showing the common mode choke coil 1 according to the first embodiment of the invention.
Figure 2B:
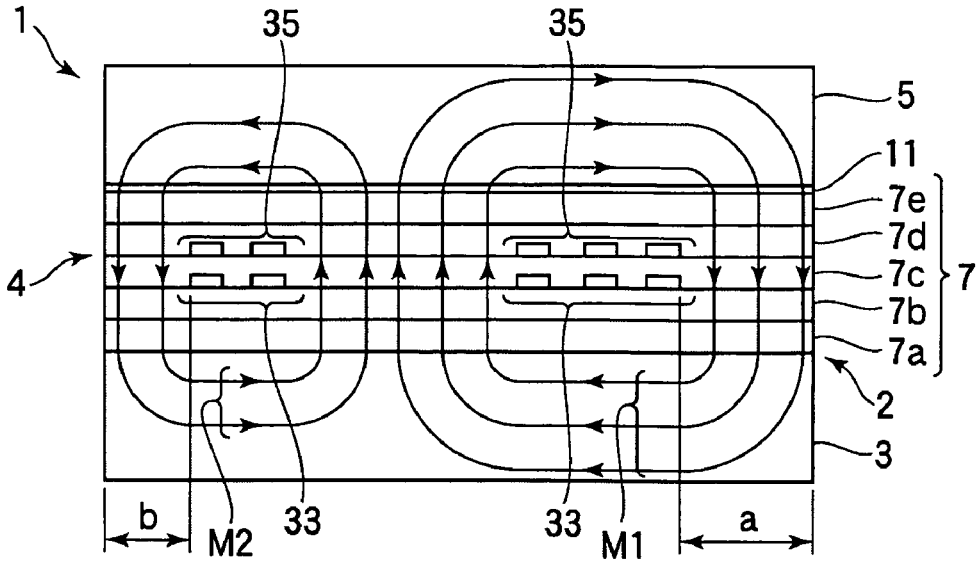

FIGS. 2A and 2B show the arrangement shape of the coil conductors 33 and 35 of the common mode choke coil 1. FIG. 2A shows the plane shape of the coil conductor 33 when viewed from a mount surface side of the common mode choke coil 1. In FIG. 2A, in order to make the drawing clear, only the coil conductor 33 is shown out of the two laminated coil conductors 33 and 35 having almost the same shape. However, the shape, arrangement relation and the like of the coil conductor 33 in the following explanation are similarly applied to the coil conductor 35. FIG. 2B shows a section taken along an imaginary line A—A passing through the center axis of the coil conductor 33 shown in FIG. 2A. As shown in FIG. 2A, the coil conductor 33 is formed into a spiral shape. An inner peripheral side end part of the coil conductor 33 is connected via a through hole 31 formed in an insulating film 7*b* to one end part of a lead wire 29 indicated by a broken line in the drawing and formed in a lower layer of the insulating film 7*b*. The other end part of the lead wire 29 is connected to the internal electrode terminal 21 formed at the peripheral end part of the insulating film 7*b*. An outer peripheral side end part of the coil conductor 33 is connected to the internal electrode terminal 25 formed to be opposite to the internal electrode terminal 21 at a peripheral end part of the insulating film 7*b*.

As shown in FIG. 2B, an insulating film 7*a*, the insulating film 7*b*, the conductive coil conductor 33, an insulating film 7*c*, the conductive coil conductor 35, an insulating film 7*d*, an insulating film 7*e*, and an adhesive layer 11 are laminated in this order between the magnetic substrates 3 and 5. The coil conductor 35 is formed into a spiral shape almost similar to the coil conductor 33, and faces the coil conductor 33 through the insulating film 7*c*. The coil conductor 35 is connected via a through hole (not shown) formed in the insulating film 7*d* to a lead wire (not shown) formed on the insulating film 7*d*. The coil conductors 33 and 35, the lead wire 29, and the lead wire connected to the coil conductor 35 are embedded in the insulating layer 7 including the insulating films 7*a*, 7*b*, 7*c*, 7*d* and 7*e* and constitute one choke coil.

The magnetic substrates 3 and 5 are formed of magnetic material such as sintered ferrite, composite ferrite or the like. Each of the insulating films 7*a*, 7*b*, 7*c*, 7*d* and 7*e* is formed by applying a material excellent in insulation performance and in workability, such as polyimide resin or epoxy resin, and patterning it into a specified shape. Each of the coil conductors 33 and 35, the lead wire 29, and the internal electrode terminals 21 and 25 is formed by forming a film of Cu, silver (Ag), aluminum (Al) or the like excellent in electric conductivity and workability and by patterning it into a specified shape.

As shown in FIG. 2A, the coil conductor 33 exhibits such a spiral shape that the internal electrode terminal 21 at the lower right in the drawing is made a starting point, and two turns and about ¼ turn are made counterclockwise toward the outside from the through hole 31 via the lead wire 29, and an end point is connected to the internal electrode terminal 25 at the upper right in the drawing. By this, as shown in FIG. 2B, the number of wiring lines (the number of turns) of the coil conductor 33 shown on the section taken along line A—A passing through at least the center axis of the coil conductor 33 is three at the right side in the drawing and two at the left side in the drawing. In general, in the case where a starting point of a coil conductor and an end point are arranged to be opposite to each other, as shown in FIGS. 2A and 2B, a region in which the number of wiring lines of the coil conductor 33 is N (N=3 in FIGS. 2A and 2B) (hereinafter referred to as a major wiring region) and a region in which the number of wiring lines is (N−1) and which is opposite to the major wiring region (hereinafter referred to as a minor wiring region) are always formed.

Then, in the common mode choke coil 1 of this embodiment, the arrangement position of the coil conductor 33 is shifted toward a substrate side part 4 as compared with the related art, and an interval "a" between an outermost peripheral end part of the major wiring region and a substrate side part 2 opposite thereto (hereinafter referred to as a major wiring side interval) is made longer than an interval "b" between an outermost peripheral part of the minor wiring region and the substrate side part 4 opposite thereto (hereinafter referred to as a minor wiring side interval). That is, the relation among the major wiring side interval "a", the minor wiring side interval "b", and the conventional interval "c" is made a>c>b and a+b=2c.

Since the number of generated magnetic flux lines is proportional to the number of wiring lines of the coil conductor 33, the number of magnetic flux lines generated around the major wiring region becomes larger than the number of magnetic flux lines generated around the minor wiring region. Since the major wiring side interval "a" is longer than the conventional interval "c", a magnetic flux passing area in the major wiring side interval "a" is wider than a magnetic flux passing area in the conventional interval "c". Thus, as shown in FIG. 2B, in the section including the center axes of the coil conductors 33 and 35, all generated magnetic flux lines can pass through the magnetic substrate 3, the insulating layer 7 at the inner peripheral parts of the coil conductors 33 and 35, the adhesive layer 11 on the insulating layer 7, the magnetic substrate 5, the adhesive layer 11 and the insulating layer 7 (magnetic path formation part 2) at the outer peripheral parts of the coil conductors 33 and 35 in this order (or in the inverse order), and a magnetic path M1 is formed substantially only in the common mode choke coil 1.

On the other hand, since the minor wiring side interval "b" is shorter than the conventional interval "c", a magnetic flux passing area in the minor wiring side interval "b" becomes narrower than the magnetic flux passing area in the conventional interval "c". However, since the number of magnetic flux lines around the minor wiring region is smaller than the number of magnetic flux lines around the major wiring region, in the section including the center axes of the coil conductors 33 and 35, all magnetic flux lines generated around the minor wiring region can pass through the magnetic substrate 3, the insulating layer 7 at the inner peripheral parts of the coil conductors 33 and 35, the adhesive layer 11 on the insulating layer 7, the magnetic substrate 5, the adhesive layer 11, and the insulating layer 7 (magnetic path formation part 4) at the outer peripheral parts of the coil conductors 33 and 35 in this order (or in the inverse order), and a magnetic path M2 is formed substantially only in the common mode choke coil 1.

By this, while the reduction in size and in profile is maintained similarly to the related art, it becomes possible to ensure the region where the relatively large magnetic flux generated around the major wiring region when power is applied to the coil conductor 33 does not leak to the outside of substrate side part 2 and passes through. Accordingly, the inductance of the coil conductors 33 and 35 can be increased, and the impedance characteristic of the common mode choke coil 1 can be improved.

Next, a manufacturing method of an electric component according to this embodiment will be described with reference to FIG. 3, while using a common mode choke coil 1 as an example. Although many common mode choke coils 1 are formed on a wafer at the same time, FIG. 3 shows a state in which a lamination structure of one common mode choke coil 1 is decomposed and is seen obliquely. Structural elements having the same operation and function as structural elements of the common mode choke coil 1 shown in FIG. 1 are denoted by the same characters and their description will be omitted.

Figure 3:
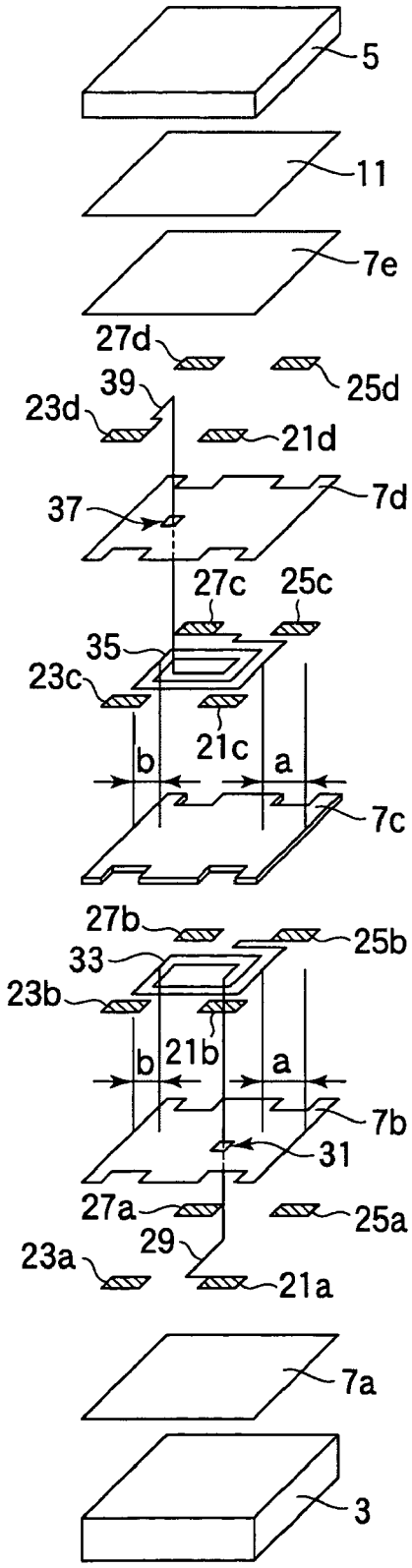
FIG. 3 is an exploded perspective view for explaining a manufacturing method of the common mode choke coil 1 according to the first embodiment of the invention.

First, as shown in FIG. 3, polyimide resin is applied onto a magnetic substrate 3 to form an insulating film 7*a*. The insulating film 7*a* is formed by a spin coat method, a dip method, a spray method, a printing method or the like. Each of insulating films described later is formed by the same method as the insulating film 7*a*.

Next, a metal layer (not shown) of Cu or the like is formed on the whole surface by a vacuum film formation method (vapor deposition, sputtering, etc.) or a plating method, and the metal layer is patterned by an etching method using photolithography, an additive method (plating) or the like to form internal electrode terminals 21*a*, 23*a*, 25*a* and 27*a* positioned on the periphery of the magnetic substrate 3. At the same time, a lead wire 29 connected to the internal electrode terminal 21*a* is formed. Each of metal layers described later is formed by the same method as the internal electrode terminals 21*a*, 23*a*, 25*a* and 27*a*.

Next, polyimide resin is applied to the whole surface and is patterned to form an insulating film 7*b* having openings in which the internal electrode terminals 21*a*, 23*a*, 25*a* and 27*a* and the end part of the lead wire 29 not connected to the internal electrode terminal 21*a* are exposed. By this, a through hole 31 in which the end part of the lead wire 29 is exposed is formed.

Next, a metal layer (not shown) of a Cu layer or the like is formed on the whole surface and a resist is applied to the whole surface. Next, an arrangement position is shifted to the left as compared with the related art so that in the state shown in FIG. 3, a major wiring side interval "a" and a minor wiring side interval "b" has a relation of a>c>b and a+b=2c with respect to a conventional interval "c", and a reticle in which a coil pattern of such a spiral shape that two turns and about ¼ turn are made counterclockwise toward the outside from the through hole 31 is drawn, is used to perform exposure and development, and the resist layer is patterned. Next, the Cu layer is etched while using the resist pattern as a mask, and a coil conductor 33 is formed. At the same time, internal electrode terminals 21*b*, 23*b*, 25*b* and 27*b* are also formed on the internal electrode terminals 21*a*, 23*a*, 25*a* and 27*a*. One terminal of the coil conductor 33 is formed on the lead wire 29 exposed in the through hole 31, and the other terminal thereof is formed to be connected to the internal electrode terminal 25*b*. By this, the internal electrode terminals 21*a* and 21*b* and the internal electrode terminals 25*a* and 25*b* are electrically connected to each other through the coil conductor 33.

Next, polyimide resin is applied to the whole surface and is patterned to form an insulating film 7*c* having openings in which the internal electrode terminals 21*b*, 23*b*, 25*b* and 27*b* are exposed.

Next, a metal layer (not shown) of a Cu layer or the like is formed on the whole surface, and a resist is applied to the whole surface. Next, an arrangement position is shifted to the left as compared with the related art so that in the state shown in FIG. 3, the major wiring side interval "a" and the minor wiring side interval "b" has a relation of a>c>b and a+b=2c with respect to the conventional interval "c", and a reticle in which a coil pattern of such a spiral shape that two turns and about ½ turn are made counterclockwise toward the outside from the through hole 37 is drawn, is used to perform exposure and development, and the resist layer is patterned. Next, the Cu layer is etched while using the resist pattern as a mask, and a coil conductor 35 is formed. At the same time, internal electrode terminals 21*c*, 23*c*, 25*c* and 27*c* are also formed on the internal electrode terminals 21*b*, 23*b*, 25*b* and 27*b*.

Next, polyimide resin is applied to the whole surface and is patterned to form an insulating film 7*d* having openings in which the internal electrode terminals 21*c*, 23*c*, 25*c* and 27*c* and the other terminal of the coil conductor 35 are exposed. By this, a through hole 37 in which the other terminal of the coil conductor 35 is exposed is formed.

Next, a metal layer (not shown) of a Cu layer or the like is formed on the whole surface and is patterned to form internal electrode terminals 21*d*, 23*d*, 25*d* and 27*d* on the internal electrode terminals 21*c*, 23*c*, 25*c* and 27*c*. At the same time, a lead wire 39 to connect the internal electrode terminal 23*d* and the other terminal of the coil conductor 35 exposed in the through hole 37 is formed. By this, the internal electrode terminals 23 (23*a*, 23*b*, 23*c* and 23*d*) and the internal electrode terminals 27 (27*a*, 27*b*, 27*c* and 27*d*) are electrically connected to each other through the coil conductor 35 and the lead wire 39.

Next, a polyimide resin is applied to the whole surface to form an insulating film 7*e*. Next, an adhesive is applied onto the insulating film 7*e* to form an adhesive layer 11. Next, a magnetic substrate 5 is fixed to the adhesive layer 11.

Next, the wafer is cut and divided into individual chip-like common mode choke coils 1. By this, the internal electrode terminals 21, 23, 25 and 27 are exposed in the section of the common mode choke coil 1. Next, the common mode choke coil 1 is polished to chamfer corner parts.

Next, although not shown, under metal films having the same shapes as external electrodes 13, 15, 17 and 19 are formed on the internal electrode terminals 21, 23, 25 and 27 of the common mode choke coil 1. The under metal film is formed by continuously forming a chromium (Cr)/Cu film or a titanium (Ti)/Cu film by a mask sputter method.

Next, the external electrodes 13, 15, 17 and 19 of a two-layer structure of nickel (Ni) and tin (Sn) are formed on the surfaces of the under metal films by electroplating, and the common mode choke coil 1 shown in FIG. 1 is completed.

As described above, according to the coil component of this embodiment, the major wiring side interval "a" is made longer than the minor wiring side interval "b" by using the manufacturing process similar to that of the related art, and the relation among the major wiring side interval "a", the minor wiring side interval "b" and the conventional interval "c" can be made a>c>b and a+b=2c. Accordingly, the small and low-profile common mode choke coil 1 having high impedance can be manufactured.

Second Embodiment

Figure 4:
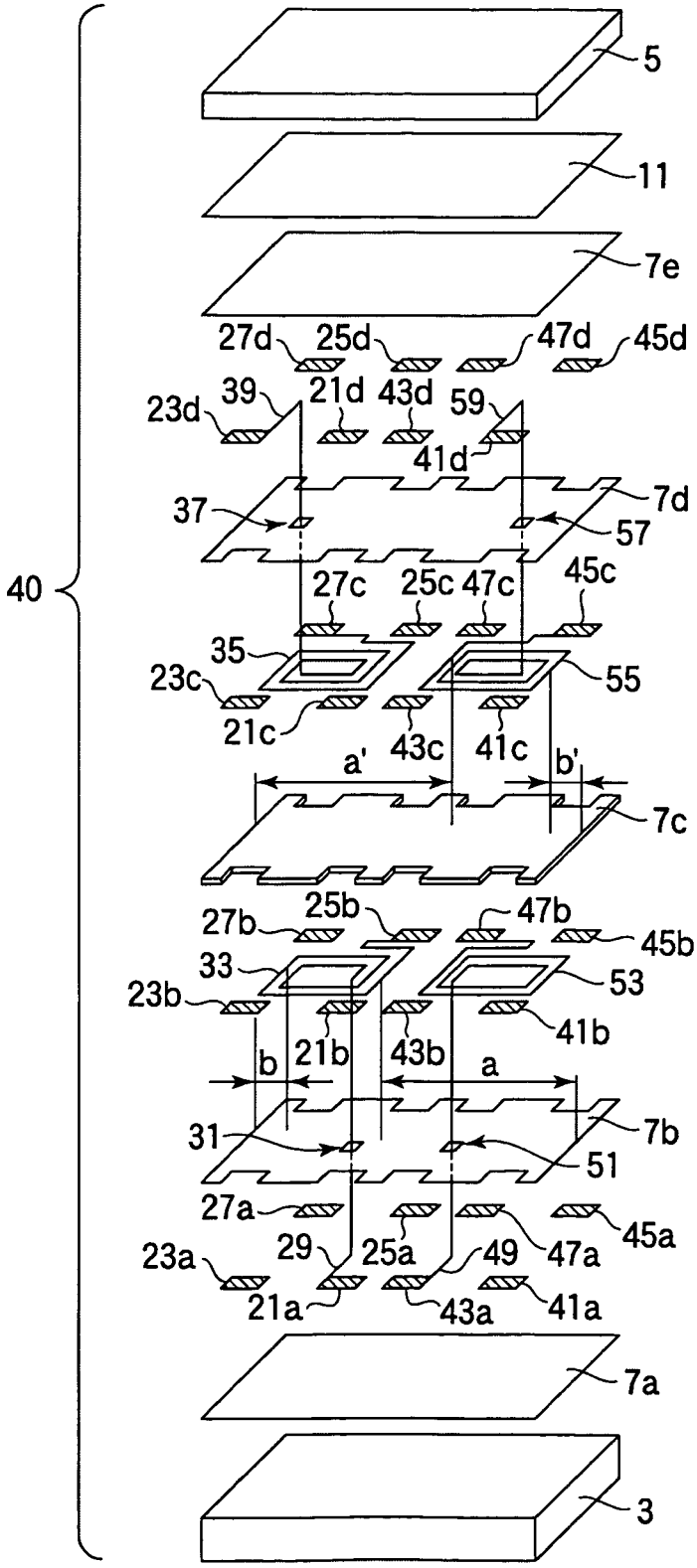
FIG. 4 is an exploded perspective view of a common mode choke coil array 40 according to a second embodiment of the invention.

A coil component according to a second embodiment of the invention will be described with reference to FIGS. 4 and 5. In this embodiment, a description will be made while using, as an example of a coil component, a common mode choke coil array 40 in which two choke coils are arranged side by side. FIG. 4 is an exploded perspective view of the common mode choke coil array 40 according to this embodiment. Structural elements having the same operation and function as structural elements of the common mode choke coil 1 shown in FIG. 1 are denoted by the same characters and their explanation will be omitted.

As shown in FIG. 4, the common mode choke coil array 40 includes, on planes parallel to the opposite surfaces of magnetic substrates 3 and 5, a common mode choke coil including coil conductors 33 and 35 and lead wires 29 and 39 laminated via insulating films, and a common mode choke coil adjacent to the common mode choke coil and including coil conductors 53 and 55 and lead wires 49 and 59 laminated via insulating films. The common mode choke coil including the coil conductors 33 and 35 has the same structure as the common mode choke coil 1 of the embodiment.

That is, the coil conductor 33 exhibits such a spiral shape that an internal electrode terminal 21 is made a starting point, and two turns and about ¼ turn are made counterclockwise toward the outside from a through hole 31 via a lead wire 29, and an end point is connected to an internal electrode terminal 25. The coil conductor 35 exhibits such a spiral shape that an internal electrode terminal 23 is made a starting point, and two turns and about ½ turn are made counterclockwise toward the outside from a through hole 37 via a lead wire 39, and an end point is connected to an internal electrode terminal 27. By this, a major wiring region of the coil conductors 33 and 35 is arranged to face on the center of the element and a minor wiring region is arranged to face on the outside of the element, so that a sufficiently long major wiring side interval "a" can be ensured with respect to a minor wiring side interval "b" as shown in FIG. 4.

Similarly, in the common mode choke coil including the coil conductors 53 and 55, an insulating film 7*a*, the conductive lead wire 49, an insulating film 7*b*, the coil conductor 53, an insulating film 7*c*, the coil conductor 55, an insulating film 7*d*, the conductive lead wire 59, an insulating film 7*e* and an adhesive layer 11 are laminated in this order between the magnetic substrates 3 and 5.

The coil conductor 53 exhibits such a spiral shape that an internal electrode terminal 43 is made a starting point, and two turns and about ¼ turn are made clockwise toward the outside from a through hole 51 via a lead wire 49, and an end point is connected to an internal electrode terminal 47. The coil conductor 55 exhibits such a spiral shape that an internal electrode terminal 41 is made a starting point, and two turns and about ½ turn are made clockwise toward the outside from a through hole 57 via a lead wire 59, and an end point is connected to an internal electrode terminal 45. By this, a major wiring region of the coil conductors 53 and 55 is arranged to face on the center of the element and a minor wiring region is arranged to face on the outside of the element, so that a sufficiently long major wiring side interval "a'" (="a") can be ensured with respect to a minor wiring side interval "b'" (="b") as shown in FIG. 4.

The coil conductors 33 and 35 and the coil conductors 53 and 55 are arranged so that the major wiring regions face each other. Thus, since the major wiring side interval "a" and the major wiring side interval "a'" can be arranged to overlap with each other, a closed magnetic path can be formed only in the common mode choke coil array 40 without generating a leakage magnetic flux to the outside of the element by the same outer appearance shape and size as the related art. Accordingly, the occurrence of the leakage magnetic flux in each of the choke coils can be prevented, and the inductance of each of the coil conductors can be increased.

Figure 5:
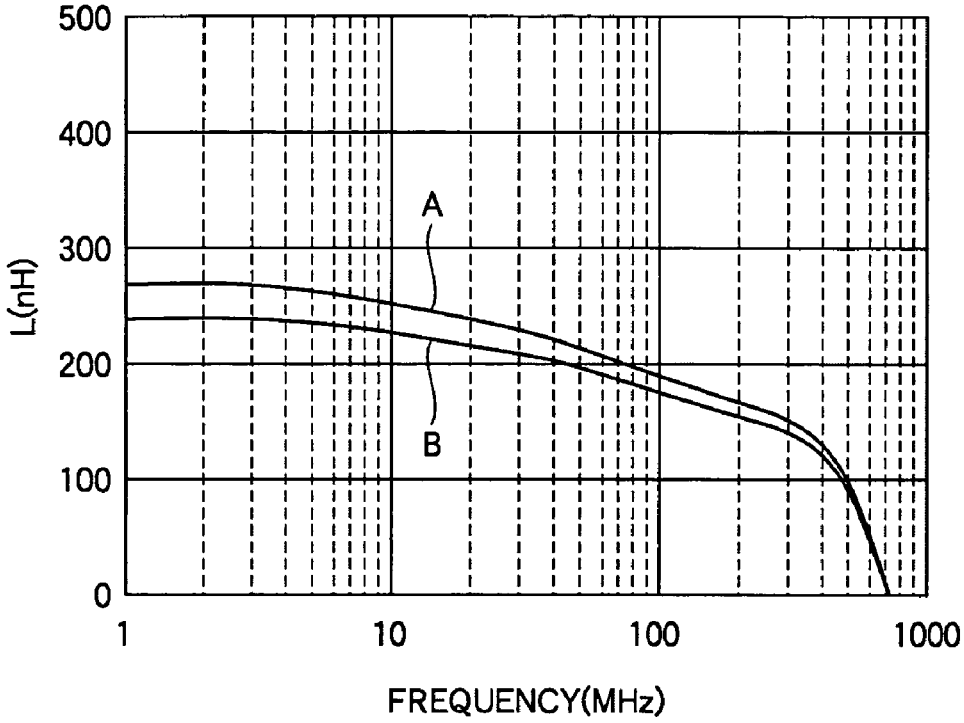
FIG. 5 is a view showing frequency characteristics of the inductance of the common mode choke coil array 40 according to the second embodiment and a conventional common mode choke coil array.
Figure 6A:
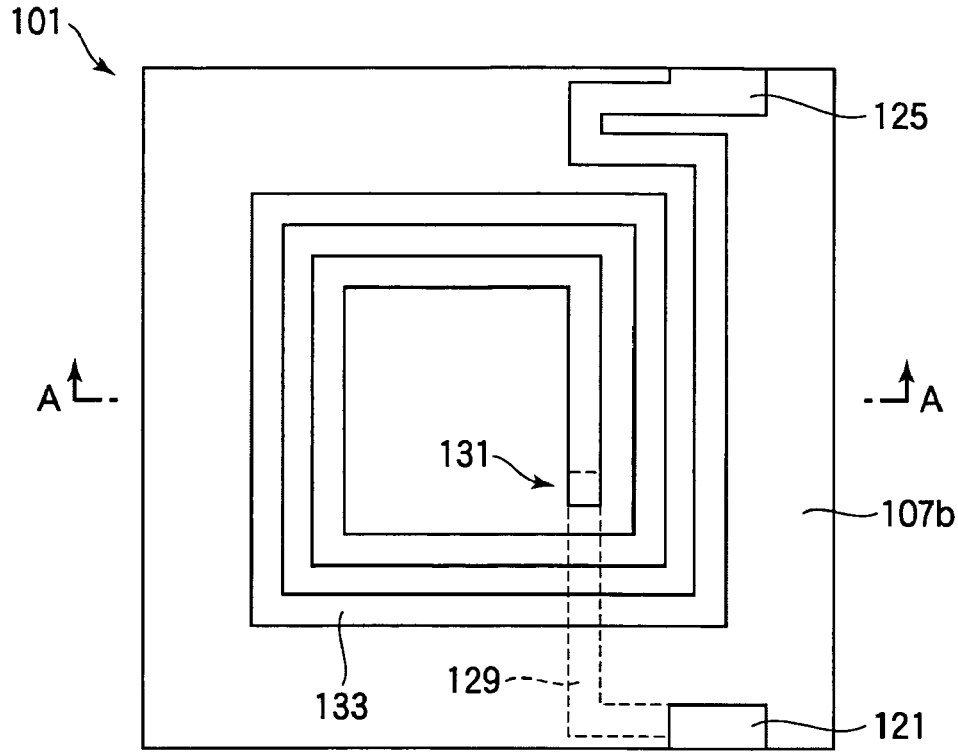
FIGS. 6A and 6B are sectional views of a conventional common mode choke coil 101.
Figure 6B:
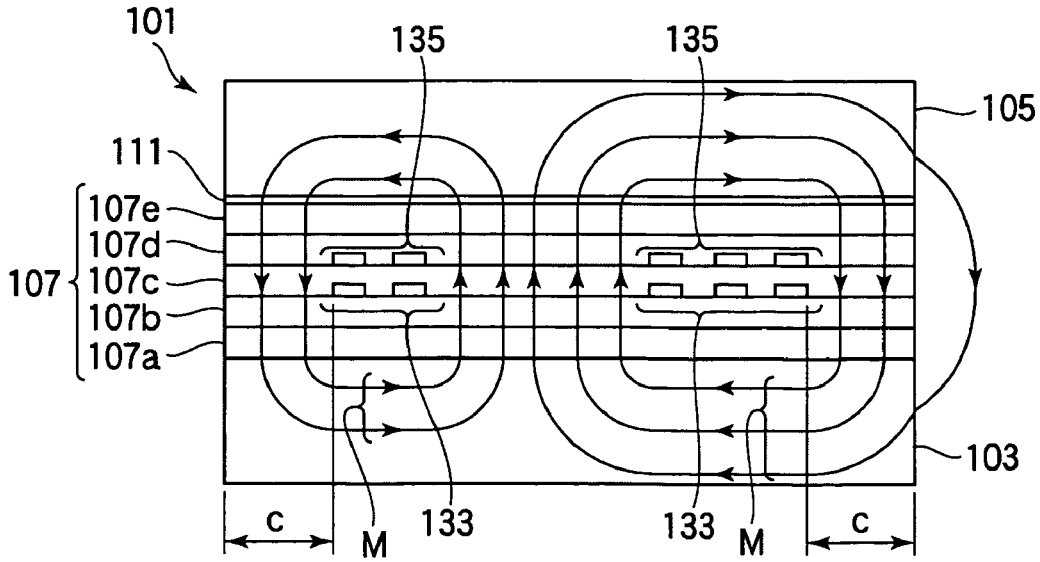

FIG. 5 shows frequency characteristics of inductance of the common mode choke coil array 40 of this embodiment and the conventional common mode choke coil array. The horizontal axis indicates the frequency (MHz) logarithmically, and the vertical axis indicates the inductance L (nH) linearly. A curved line A in the drawing indicates the characteristic of the common mode choke coil array 40 of this embodiment, and a curved line B indicates the characteristic of the conventional common mode choke coil array. Both the common mode choke coil array 40 and the conventional common mode choke coil array are so-called 2010-type coil components, and the outer size is such that the horizontal length is 2.0 mm, the vertical length is 1.0 mm, and the height is 0.85 mm. The major wiring side interval "a", "a'" of the common mode choke coil array 40 is 1.2 mm, and the minor wiring side interval "b", "b'" is 0.2 mm.

In the conventional common mode choke coil array, the minor wiring regions of the two coil conductors arranged side by side are disposed to face each other. Thus, in the conventional common mode choke coil array, the major wiring side interval is 0.2 mm, and the minor wiring side interval is 1.2 mm. The common mode choke coil array 40 of this embodiment and the conventional common mode choke coil array are formed to be equal to each other except the arrangement of the choke coils.

As shown in FIG. 5, the common mode choke coil array 40 of this embodiment has a larger inductance than the conventional common mode choke coil array does. In the conventional common mode choke coil array, since the major wiring side interval is short, the area through which many magnetic flux lines pass becomes narrow. Thus, a leakage magnetic flux is generated, and the inductance of the common mode choke coil array can not be increased. On the other hand, in the common mode choke coil array 40 of this embodiment, the major wiring side interval "a" is made long, and the magnetic flux passing area is sufficiently ensured. Thus, the occurrence of a leakage magnetic flux is prevented, and the magnetic path can be formed only in the common mode choke coil array 40. By this, the inductance of the common mode choke coil array 40 becomes larger than the inductance of the conventional common mode choke coil array.

Since the manufacturing method of the common mode choke coil array 40 is the same as the manufacturing method of the above embodiment, the description will be omitted.

As described above, according to the coil component of this embodiment, in the common mode choke coil array 40, the major wiring regions of the two choke coils are arranged to face each other, so that the inductance can be increased. By this, the small and low-profile common mode choke coil array 40 having the high impedance can be manufactured.

The invention is not limited to the embodiments, but can be variously modified.

In the second embodiment, although the description has been made while using, as the example, the common mode choke coil array 40 including two pairs of the coil conductors 33 and 35 and the coil conductors 53 and 55 arranged side by side, the invention is not limited to this. For example, one or not less than two coil conductors may be further added between the two pairs of the coil conductors arranged side by side and they may be arranged side by side. Since the added coil conductors are arranged between the two pairs of the coil conductors 33 and 35 and the coil conductors 53 and 55, a major wiring side interval "a" having a sufficient length and corresponding to a major wiring region can be ensured, and therefore, the same effect as the above embodiment can be obtained.

Besides, although the coil components according to the first and the second embodiments have been described while the common mode choke coil 1 and the common mode choke coil array 40 are used as the examples, the invention is not limited to these. For example, even when the invention is applied to coil components used for measure against noise, for a resonant circuit and for impedance matching, the same effect can be obtained.

What is claimed is:

1. A coil component comprising:

a pair of substrates arranged to be opposite to each other; and a coil conductor provided to have a spiral shape between the pair of substrates, and including a major wiring region having the number N of wiring lines and a minor wiring region arranged to be opposite to the major wiring region and having the number (N−1) of wiring lines, wherein a major wiring side interval as an interval between an outermost periphery of the major wiring region and one side part of the substrate opposite thereto is longer than a minor wiring side interval as an interval between an outermost periphery of the minor wiring region and the other side part of the substrate opposite thereto.

2. A coil component according to claim 1, wherein the two coil conductors are arranged side by side while the major wiring regions face each other.

3. A coil component according to claim 1, further comprising another coil conductor between the two coil conductors.

4. A coil component according to claim 1, wherein a magnetic flux passing area in the major wiring side interval is wider than a magnetic flux passing area in the minor wiring side interval.

5. A coil component according to claim 1, further comprising an opposite coil conductor arranged to be opposite to the coil conductor through an insulating film for constituting a common mode choke coil.

* * * * *